US008783363B2

(12) United States Patent
Dommati et al.

(10) Patent No.: US 8,783,363 B2
(45) Date of Patent: Jul. 22, 2014

(54) MULTIFUNCTIONAL KEY DESIGN FOR METAL SEAL IN SUBSEA APPLICATION

(75) Inventors: Thirupathi Dommati, Bangalore (IN); Milind Appasaheb Ghumre, Bangalore (IN); Murugan Mahalingam, Bangalore (IN)

(73) Assignee: Vetco Gray Inc., Houston, TX (US)

( * ) Notice: Subject to any disclaimer, the term of this patent is extended or adjusted under 35 U.S.C. 154(b) by 173 days.

(21) Appl. No.: 13/374,908

(22) Filed: Jan. 23, 2012

(65) Prior Publication Data

US 2013/0187338 A1 Jul. 25, 2013

(51) Int. Cl.
*E21B 33/08* (2006.01)
*E21B 23/00* (2006.01)

(52) U.S. Cl.
USPC ..... 166/368; 166/360; 166/378; 166/348; 166/381; 166/341

(58) Field of Classification Search
USPC ..... 166/368, 378, 381, 208, 348, 242.1; 285/343
See application file for complete search history.

(56) References Cited

U.S. PATENT DOCUMENTS

| | | | | |
|---|---|---|---|---|
| 2,605,623 | A | 8/1952 | Thylefors | |
| 4,177,352 | A | 12/1979 | Dunbar et al. | |
| 4,520,566 | A | 6/1985 | Davis | |
| 4,751,965 | A * | 6/1988 | Cassity | 166/182 |
| 4,921,259 | A | 5/1990 | Saunders | |
| 5,174,376 | A * | 12/1992 | Singeetham | 166/208 |
| 5,325,925 | A * | 7/1994 | Smith et al. | 166/387 |
| 5,456,314 | A | 10/1995 | Boehm, Jr. et al. | |
| 5,503,230 | A | 4/1996 | Osborne et al. | |
| 5,839,512 | A | 11/1998 | Malone et al. | |
| 6,510,895 | B1 * | 1/2003 | Koleilat et al. | 166/208 |
| 6,749,018 | B1 | 6/2004 | Ford et al. | |
| 7,559,366 | B2 * | 7/2009 | Hunter et al. | 166/217 |
| 8,006,764 | B2 | 8/2011 | Adamek et al. | |
| 2010/0300705 | A1 | 12/2010 | Nelson | |

FOREIGN PATENT DOCUMENTS

| | | | |
|---|---|---|---|
| GB | 2251012 | A | 6/1992 |
| GB | 2274477 | A | 7/1994 |
| GB | 2489574 | A | 10/2012 |

OTHER PUBLICATIONS

Search Report from corresponding GB Application No. GB 1300767.9 dated Apr. 17, 2013.

* cited by examiner

*Primary Examiner* — James Sayre
(74) *Attorney, Agent, or Firm* — Bracewell & Giuliani LLP

(57) ABSTRACT

A wellbore sealing assembly can include a sealing ring, an energizing ring, and a multifunctional key for engaging the sealing ring and the energizing ring. The multifunctional key can have a key body, a guide member, and a retainer stud. The key body can be located in an aperture in a sidewall of the sealing ring and the guide member and retainer stud can protrude through the sidewall into a guide slot and recess of the energizing ring. Downward force on the energizing ring can cause the retainer stud to shear away while the guide member travels in the guide slot to prevent rotation of the energizing ring relative to the sealing ring. The guide member can also aid in complete seal retrieval by locking against the bottom of the key-way slot in the energizing ring.

19 Claims, 2 Drawing Sheets

MULTIFUNCTIONAL KEY DESIGN FOR METAL SEAL IN SUBSEA APPLICATION

BACKGROUND OF THE INVENTION

1. Field of the Invention

The present invention relates in general to a key used during the insertion of annular seals, and in particular to a multifunctional key that can be used to prevent rotation, guide, and retrieve a metal seal.

2. Brief Description of Related Art

Annular sealing rings are used in wellbore applications for sealing between wellbore members. For example, a metallic sealing ring can be used seal between a casing hanger and a wellhead housing in a subsea well application. An energizing ring can be used to set, or energize, a metallic sealing ring. A problem can occur when an energizing ring begins to prematurely engage a seal—either while the energizing ring and seal are being lowered through the casing or just prior to setting the seal, but before the seal is in the correct location.

SUMMARY OF THE INVENTION

In one embodiment, the present invention can be used for setting a metal-to-metal seal in subsea wellhead equipment, but can be applied in any seal setting application that requires anti-rotation, shear force during installation, and retrieval of metal seals. In one embodiment, a key can be threaded into a hole in a sidewall of a seal and seated in a hole in an energizing ring. During setting, a portion of the key, seated in a hole in the energizing ring, can shear off, and can travel in the energizing ring. The remainder of the key, being installed in and protruding from the seal, can act as an anti-rotation key by reacting against the key slot in the energizing ring. The protruding portion of the key can also aid in complete seal retrieval by locking against the bottom of the key-way slot in the energizing ring.

The multifunctional key can include a cylindrical component that can have three regions—a threaded region, an anti-rotation and retrieval member, and a stud that can be sheared off. The key can be installed after the seal and energizing ring are assembled. The key can be screwed into the threaded hole in the seal, and a portion of the key can be seated in a blind hole, or pocket, in the energizing ring. The stud can engage the pocket, in the energizing ring to prevent the seal from moving relative to the energizing ring. When a setting force on the energizing ring reaches a predetermined value, the stud can be sheared off. The force required to shear the stud can be determined by the material and shape of the stud, as well as the number of keys used. After the stud is sheared off, the threaded region and guide member protruding from the sidewall of the seal can act-on the key-way to prevent rotation of the seal relative to the energizing ring, but still allow axial movement for seal setting. The protruding guide member can catch on the bottom of the key-way during seal retrieval.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not, be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used indicates similar elements in alternative embodiments.

Figure 1:
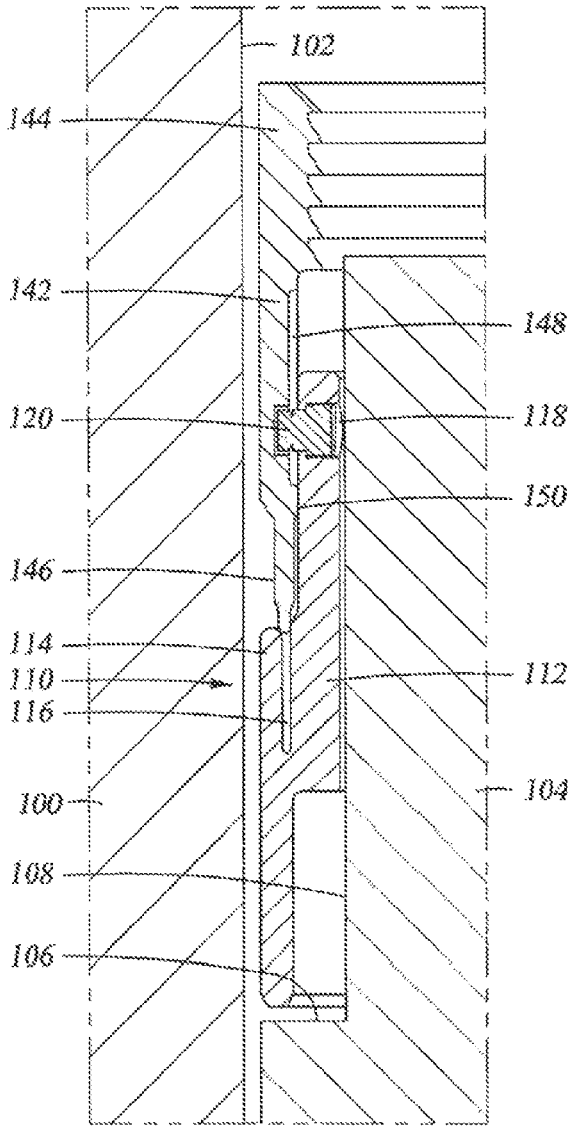
FIG. 1 is a partial sectional view of an exemplary embodiment of a system having a multifunctional key in a wellbore application.

Referring to FIG. 1, a wellhead housing 100 is presented. In the illustrated embodiment, the wellhead housing 100 is a conventional high pressure housing for a subsea well. It is a large tubular member located at the upper end of a well, such as a subsea well. Wellhead housing 100 has an axial bore 102 extending through it. A casing hanger 104 lands in the wellhead housing 100. Casing hanger 104 is a tubular conduit, secured to the upper, end of a string of casing (not shown). Casing hanger 104, has an upward facing shoulder 106 on its exterior. The exterior wall 108 of casing hanger 104 is parallel to the wall of bore 102 but spaced inwardly. This, results in an annular pocket or clearance between casing hanger exterior wall 108 and bore 102.

A seal assembly 110 lands in the pocket between casing hanger exterior wall 108 and bore wall 102. Seal assembly 110 may be made up entirely of metal components. Seal assembly 110 can include an annular base ring such as seal body 112. Seal assembly 110 can also include seal member 114, which can be a leg protruding from seal body 112. Seal member 114 can be connected to seal body at the bottom by a base and open at the top. The inner diameter of seal member 114 can be radially spaced outward from the outer diameter of seal body 112, resulting in annular clearance 116 there between. Seal member 114 and seal body 112 can be forced apart such, that each will sell against an adjacent surface. As one of skill in the art will appreciate, other types of, seal members can be used including, for example, U-shaped seals having two legs (not shown) wherein each leg can be a sealing surface and H-seals wherein four sealing surfaces can be employed. In some embodiments, seal member 114 and seal body 112 can be forced against parallel ridges and grooves, also known as wickers (not shown) to enhance the sealing properties.

Key support aperture 118 can be an aperture, such as a threaded hole, through seal body 112. In one embodiment, key support aperture 118 can extend, perpendicularly, outward from the axis of seal assembly 110. A plurality of key support apertures 118 can be spaced apart around the circumference of seal assembly 110. For example, four key support apertures 118 can be spaced evenly apart around seal assembly 110. Alternatively, two, five, or any number of key support apertures can be evenly spaced or unevenly spaced around seal assembly 110.

Figure 2:
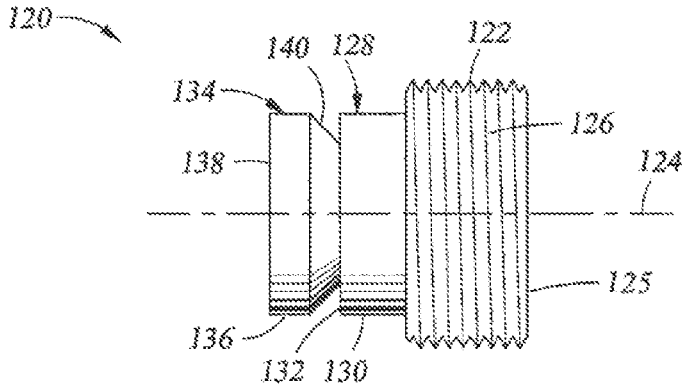
FIG. 2 is a side view of the multifunctional key of FIG. 1.

Referring to FIGS. 1 and 2, a key 120 is a multifunctional key that can be connected to seal assembly 110. Key 120 can include key body 122, which can be inserted into and retained by key support aperture 118. Key axis 124 of key 120 can be normal to the sidewall of seal body 112 when key 120 is connected. In one embodiment, key body 122 can be a cylindrical body having threads 126 on its outer diameter. Threads 126 can engage corresponding threads in key support aperture 118 so that key 120 can threadingly engage and be retained by key support aperture 118. Other techniques can be used to connect key 120 to seal assembly 110 including, for example, welding epoxy, or press fit. A tool receptacle (not shown) can be located on end 125 of key 120. The tool receptacle can be, for example, a slot that can be engaged by a screwdriver, a hex that can be engaged by a hex key, or any other type of feature to facilitate rotating key 120 with a tool or by hand.

Guide member 128 can protrude from the face of key 120 opposite of end 125. Guide member 128 can have a cylindrical shape, a square shape, or any other shape. In one embodiment guide member 128 has a width that is less than the width of key body 122, thereby allowing guide member to pass through key support aperture 118 ahead of key body 122. In one embodiment, guide member 128 can have a sidewall 130 that can be parallel to key axis 124. The axial length of sidewall 130 can be relatively smaller than the diameter or width of guide member 128. Shear face 132 can be an end of guide member 128, opposite of key 120.

A retainer stud 134 can protrude from guide member 128 at shear face 132. Retainer stud 134 can be formed integrally with or be attached to guide member 128. In one embodiment, retainer stud 134 can have a generally cylindrical shape, rotated about key axis 124. Retainer stud 134 can have a cylindrical stud sidewall 136 and a-stud end face 138. The outer diameter of stud sidewall 136 can be approximately equal to the outer diameter of guide member 128, and can taper inward, at taper 140, as it approaches shear face 132. As best shown in FIG. 2, taper 140 has a smaller outer diameter near shear face 132. A portion of shear face 132 can be exposed because the narrow portion of taper 140 has an outer diameter that is smaller than the outer diameter of guide member 128. In embodiments where guide member 128 is not round, taper 140 can still have a smaller cross sectional area than the cross sectional area of guide member 128, thus exposing a portion of shear face 132. In one embodiment, the profile of retainer stud 134 matches the profile of guide member 128, and thus shear face 132 is not exposed. In one embodiment, rather than having a taper, a groove or cut (not shown) can be located in the outer diameter of stud sidewall 136, at shear face 132.

Retainer stud 134 can shear away from guide member 128 in response to a predetermined amount of shear force. In one embodiment, shear face 132 defines the weakest portion of key 120, such that a shear force will cause retainer stud 134 to shear away from guide member 128 at shear face 132. In embodiments having taper 140, the smaller cross section at shear face 132 can contribute to making that location the weak spot even if retainer stud 134 and guide member 128 are integrally formed of the same material. The cross sectional area at shear face 132 can be selected to determine the level of force required to shear retainer stud 134 away from guide member 128. Furthermore, the material selected for key 120 and any of the components thereof can be chosen for a desired shear force at a given cross sectional area. In embodiments wherein retainer stud 134 is adhered to guide member 128 at shear face 132, the adhesive can be selected to shear in response a particular level of force.

Referring back to FIG. 1, an energizing ring 142 can be employed to energize an annular seal. In one embodiment, energizing ring 142 can force seal member 114 radially outward from seal body 112 and into sealing engagement with a wellbore member such as wellhead housing 100. Energizing ring 142 can have upper body 144 and a force ring 146 extending from upper body 144. An outer diameter of force ring 146 can frictionally engage the inner diameter of seal member 114. An inner diameter of force ring 146 can frictionally engage an outer diameter of seal body 112. The radial thickness of energizing ring 142 can be greater than, the initial radial dimension of the clearance 116 such that when force ring 146 is inserted into clearance 116, seal member 114 is deformed against wellhead housing. 100 and seal body 112 is deformed against casing hanger 104.

Figure 3:
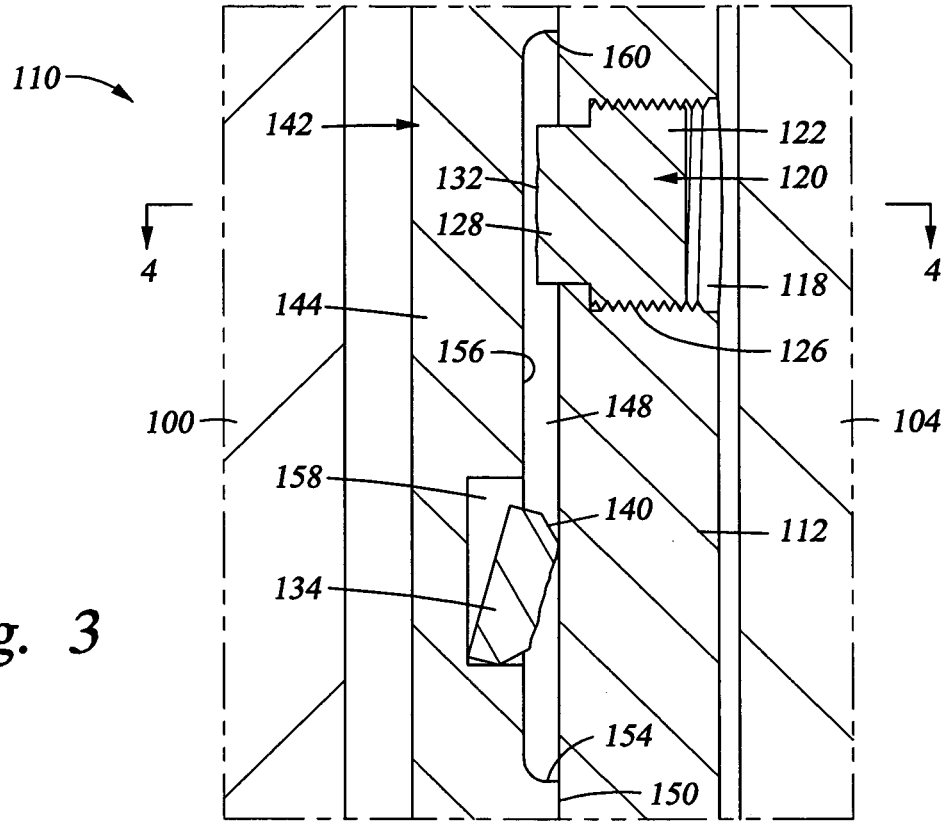
FIG. 3 is a partial sectional view of the system of FIG. 1, showing the multifunctional key after the seal has been energized.
Figure 4:
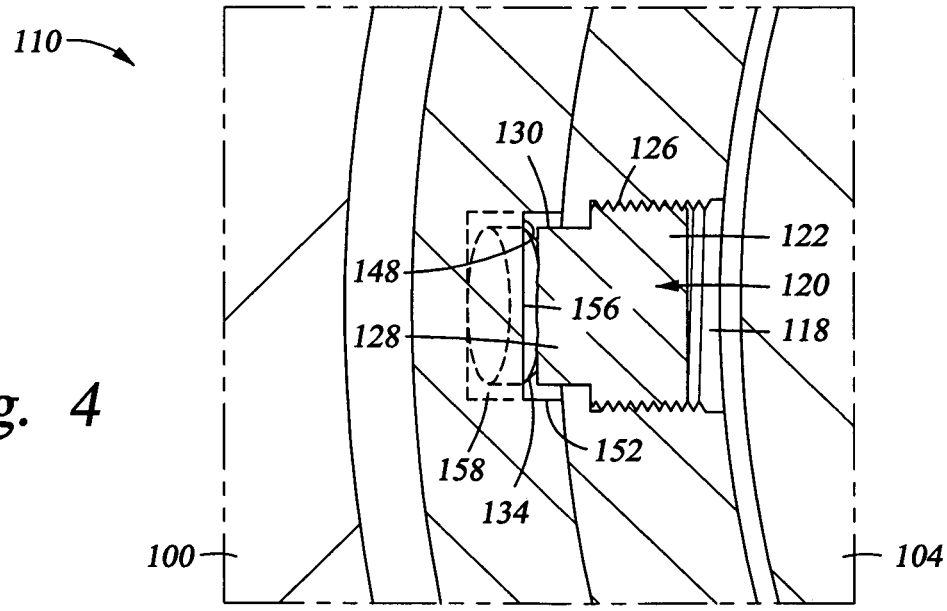
FIG. 4 is across sectional view of the system of FIG. 3, taken along the 4-4 line.

Referring to FIGS. 1, 3, and 4, a guide slot 148 can be a vertical groove on inner diameter 150 of upper body 144. One or more guide slots 148 can be spaced apart around energizing ring 142. A plurality of guide slots 148 can be evenly spaced apart or spaced at odd intervals. One or more of the guide slots 148 can be aligned with one or more of the key support apertures 118. As best shown in FIGS. 1 and 4, guide slot 148 can have axial sidewalls 152 and an upward facing shoulder 154. The width of guide slot 148 can be greater than the width of guide member 128. The axial length of guide slot 148 can be equal to or greater than the sum of (1) the axial travel distance that energizing ring 142 must travel to set seal assembly 110, and (2) the diameter or height of guide member 128. The radial depth of guide slot 148, from the inner diameter of upper body 144 to back surface 156 can be greater than the axial length of guide member 128 but less than the combined axial length of guide member 128 and, retainer stud 134.

Still referring to FIGS. 1 and 4, stud recess 158 can be, a recess located in back surface 156, near the bottom of guide slot 148. As best shown in FIG. 4, stud recess 158 can have a width greater than the width of retainer stud 134. The radial depth of stud recess 158 is deeper than the radial depth of guide slot 148 and is deep enough to accommodate retainer stud 134 before, retainer stud 134 has sheared away from guide member 128, when key 120 is installed in key support aperture 118. Stud recess 158 can be a cylindrical hole and can have an upward facing shoulder contacted by a lower side of retainer stud 134.

Seal assembly 110 and energizing ring 142 can be carried on a running tool (not shown) in a run-in position. The run-in position is best shown in FIG. 1. In the run-in position, guide slot 148 and key support aperture 1.18 can be circumferentially aligned, as best shown in FIG. 4. Furthermore, in the run-in position, key support aperture 118 and stud recess 158 can be concentrically aligned so that key 120 can be inserted into key support aperture 118 to cause guide member 128 and retainer stud 134 to protrude through upper body 144, with retainer stud 134 being located in, stud recess 158. In the run-in position, energizing ring 142 is held above seal assembly 110 such, that force ring 146 does not radially displace seal member 114. Because retainer stud 134 is located in stud recess 158, energizing ring 142 cannot move axially relative to seal assembly 110 unless or until retainer stud 134 is sheared away from guide member 128. Keys 122 can also retain seal assembly 110 on energizing ring 142 while the assembly is run into the wellbore, thus preventing seal assembly 110 from separating and falling away from energizing ring 142.

As described above, the predetermined force required to shear-retainer studs 134 from guide members 128 can be controlled by selecting particular materials for keys 122; adhesives for connecting shear retainer studs 134, or selecting particular cross-sectional widths at the point between shear face 132 and taper 140. Furthermore, the force required to shear retainer studs 134 can be controlled by the number of keys 122 used in a particular assembly. A greater number of keys 122 can be used for applications where a greater shear force is required. Not all key support apertures 118 on a particular seal assembly 110 need to be populated. If a lower shear force is desired, one or more key support apertures 118 can be left empty.

During installation, seal assembly 110 lands on upward facing shoulder 106, thus preventing further downward movement of seal assembly 110. Keys 122 can continue to prevent energizing ring 142 from energizing seal assembly 110 until a predetermined amount of force is exceeded, thus shearing retainer studs 134 from guide members 128. The operator can then increase force on the running tool (not shown) until retainer studs 134 are sheared away. Once they have sheared; continued downward force on energizing ring 142 can cause energizing ring 142 to move from the run-in position to an energized position. In the energized position, force ring 146 enters annular clearance 116, thereby urging seal member 114 radially against a sealing surface such as wellhead housing 100, and also urging a sealing portion of seal body 112 against a sealing surface such as casing hanger 104. In embodiments having multiple seals (not shown) on seal assembly 110, such as H-seals or U-shaped seals having multiple sealing rings, energizing ring 142 can energize the seals in a conventional manner after retainer stud 134 has sheared. As best shown in FIG. 3, the now-sheared retainer stud 134 can remain in stud recess 158 as energizing ring 142 moves from the run-in position to the energized position.

As best shown In FIG. 4, as energizing ring 142 engages seal assembly 100, guide member 128 can slidingly engage guide slot 148, thereby preventing annular rotation of energizing ring 142 relative to seal assembly 110 even after retainer stud 134 shears. Key 120, specifically, retainer stud 134 and guide member 128, remain stationary with the landed seal assembly 110 as energizing ring 142 moves downward, The axial height of guide slot 148 permits energizing ring 142 to fully energize seal assembly 110 before guide member 128 contacts top surface 160 of guide slot 148. After energizing seal assembly 110, the operator can withdraw the running tool not shown).

To withdraw seal assembly 110, an operator can connect a running tool (not shown) to energizing ring 142, and then pull upward on energizing ring 142. Upon reaching sufficient upward force to disengage forcing ring 146 from annular clearance 116, energizing ring 142 can move upward relative to seal assembly 110. Guide member 128 in guide slot 148 can prevent annular rotation of energizing ring. 142 during the withdrawal. Energizing ring 142 can move upward, relative to seal assembly 110, until upward facing shoulder contacts guide member 128. Upon contact, force can be transferred from energizing ring 142, through seal key 120, to seal assembly 110, until seal assembly 110 is lifted up and out of its position. As energizing ring 142 moves upward, guide slot 148 detached retainer stud 134 also move up. Taper 140 on retainer stud 134 can help retainer stud move up without catching on guide member 128.

While the invention has been shown or described in only some of its forms, it should be apparent to those skilled in the art that it is not so limited, but is susceptible to various changes without departing from the scope of the invention.

What is claimed is:

1. A wellbore sealing assembly, the wellbore sealing assembly comprising;

a sealing ring having an axis;

an energizing ring concentric with the sealing ring and moveable between an upper and a lower position, the sealing ring and the energizing ring having mating cylindrical surfaces that slide against one another while moving from the upper to the lower position;

an axially extending guide slot on one of the cylindrical surfaces;

a recess in the guide slot of defining an upward facing shoulder; and a key extending from the other cylindrical surface, the key having a guide member and having a retainer stud portion extending through the guide slot into the recess, the key having a weak point, within the guide slot and at an entrance of the recess between the guide member and the retainer stud, so that a downward force on the energizing ring shears the retainer stud portion at the weak point to allow downward movement of the energizing ring relative to the sealing ring, and a portion of the key remains within the guide slot to prevent rotation of the energizing ring and sealing ring relative to each other as the energizing ring moves to the lower position.

2. The wellbore sealing assembly according to claim 1, wherein the key body comprise a cylinder having threads on an outer diameter;

the guide member comprises a cylinder having a smaller outer diameter than the outer diameter of the key body and an outer diameter of the retainer stud is smaller than the outer diameter of the guide member at the point where the multifunctional key transitions from the guide member to the retainer stud.

3. The wellbore sealing assembly according to claim 2, wherein the key body, guide member, and retainer stud are integrally formed as a single member prior to the retainer stud shearing.

4. The wellbore sealing assembly according to claim 1, wherein the key further comprises a tapered surface a the weak point.

5. The wellbore sealing assembly according to claim 1, wherein the guide slot comprises an axial groove on an inner diameter of the energizing ring and the recess is at least partially located within the guide slot, the radial depth of the recess being greater than the radial depth of the guide slot.

6. The wellbore sealing assembly according to claim 1, wherein the guide slot has an upward facing shoulder at a lower end; wherein upward three on the energizing ring cause the energizing ring to move upward relative to the sealing ring until the upward facing shoulder contacts the guide member; and wherein continued upward force is transferred from the upward facing shoulder to the guide member to withdraw the sealing ring.

7. The multifunctional key Of claim 1, wherein the cylindrical key body, the guide member, and the retainer stud are integrally formed of the same material.

8. The multifunctional key of claim 1, wherein a centerpoint of the recess coincides With a centerpoint of the guide slot.

9. A method of sealing a wellbore, the method comprising the steps of:

a. providing an assembly comprising;

a sealing ring having an axis, an energizing ring concentric with the sealing ring and moveable between an upper and a lower position, the sealing ring and the energizing ring having mating cylindrical surfaces that slide against one another while moving from the upper to the lower position;

an axially extending guide slot on one of the cylindrical surfaces;

a recess in the guide slot defining an upward facing shoulder;

a key extending from the other cylindrical surface and having a retainer stud portion extending through the guide slot into the recess, the key having a weak point within the guide slot and at an entrance of the recess, so that a downward three on the energizing ring shears the retainer stud portion at the weak point to allow downward movement of the energizing ring relative to the sealing, and a portion of the key remains within the guide slot to prevent rotation of the energizing ring and sealing ring relative to each other as the energizing ring moves the lower position;

b. lowering the assembly into a wellbore assembly until downward movement of the annular settling ring is stopped by contact with the wellbore assembly;

c. exerting increased downward force on the energizing ring until the retainer stud is detached from a guide member thereby allowing, downward movement of the energizing ring relative to the seal assembly; and d. a portion of the key remaining in the guide slot after the retainer stud is detached, so as to prevent rotation of the energizing, ring and sealing ring relative to each other as the energizing ring moves downward.

10. The method of claim 9, further comprising the step of withdrawing the seal assembly by exerting upward force on the energizing ring and transferring the upward force from the energizing ring, through the guide member, to the sealing ring.

11. The method of claim 10, wherein the guide slot comprises an upward facing shoulder, and wherein the guide member engages the upward facing shoulder.

12. A wellbore sealing assembly, the wellbore sealing assembly comprising:

an annular sealing ring having a sealing ring axis, comprising a sealing member and a sidewall, the sidewall having an aperture therethrough that is perpendicular to the axis;

an energizing ring concentrically located within the sealing ring and having an axially extending elongated guide slot having a back, surface;

a recess formed in the back surface of the guide slot, the recess and a portion of the guide slot being radially and axially aligned with the aperture when the energizing ring is in a first position relative to the sealing ring;

a key having a having a key body, a guide member extending from the key body, and a retainer stud extending from the guide member, at least a portion of the key body being, located in the aperture of the sealing ring with at least a portion of the guide member protruding from the sidewall into the guide slot, and the retainer stud protruding into the recess; and the energizing ring being movable from the first position to a second position, the movement from the first position to the second position causing the retainer stud to shear off of the guide member, while the guide member remains in the guide slot to prevent rotation between the energizing ring and the sealing, ring while the energizing ring moves to the second position.

13. The Wellbore sealing assembly according to claim 12, wherein the key body comprises a cylinder having threads on an outer diameter;

the guide member comprises a cylinder having a smaller outer diameter than the outer diameter of the key body; and an outer diameter of the retainer stud is smaller than the cuter diameter of the guide member at the point where the multifunctional key transitions from the guide member to the retainer stud.

14. The wellbore sealing assembly according claim 13, wherein the key body, guide member, and retainer stud are integrally formed as single member prior to the retainer stud shearing.

15. The wellbore sealing assembly according to claim 12, wherein the key comprises a weak point between the guide member and the retainer stud.

16. The wellbore sealing assembly according to claim 15, wherein the key further comprises a tapered surface at the weak point.

17. The wellbore sealing assembly according to claim 12, wherein the guide slot comprises an axial groove, on an inner diameter of the energizing ring and the recess is at least partially located within the guide slot, the radial depth of the recess being greater than the radial depth of the guide slot.

18. The wellbore sealing assembly according to claim 12, wherein the guide slot has an upward lacing shoulder at a lower end; wherein upward force on the energizing ring causes the energizing ring to move upward relative to the searing ring until the upward facing shoulder contacts the guide member; and wherein continued upward force is transferred from the upward racing shoulder to the guide member to withdraw the

19. The multifunotional key of claim 12, wherein the cylindrical key body, the guide member, and the retainer, stud are integrally formed of the same material.

* * * * *